US006317998B1

(12) United States Patent
Benevelli

(10) Patent No.: US 6,317,998 B1
(45) Date of Patent: Nov. 20, 2001

(54) HAIR-DRYING APPARATUS

(76) Inventor: Giulio Benevelli, no. 20, Via Gorizia, I-42100 Reggio Emilia (IT)

( * ) Notice: Subject to any disclaimer, the term of this patent is extended or adjusted under 35 U.S.C. 154(b) by 0 days.

(21) Appl. No.: 09/617,544

(22) Filed: Jul. 14, 2000

(30) Foreign Application Priority Data

Jul. 20, 1999 (IT) ..... RE99A0074

(51) Int. Cl.[7] ..... A45D 20/00

(52) U.S. Cl. ..... 34/97; 34/96; 219/222; 392/380; 392/384

(58) Field of Search ..... 34/96, 97; 392/380, 392/379, 383, 384; 219/222

(56) References Cited

U.S. PATENT DOCUMENTS 4,097,722 * 6/1978 Soler et al. ..... 219/368
5,058,193 * 10/1991 Appierto ..... 392/384

* cited by examiner

*Primary Examiner*—Pamela Wilson
(74) *Attorney, Agent, or Firm*—Browdy and Neimark

(57) ABSTRACT

The hair-drying apparatus, the handle of which is provided below and transversally with respect to the body of the apparatus, is provided with a sliding regulating shutter at a delivery mouth thereof; axes of the motor and the delivery duct being reciprocally offset. The apparatus offers a greater operational flexibility and versatility.

5 Claims, 3 Drawing Sheets

Fig.3
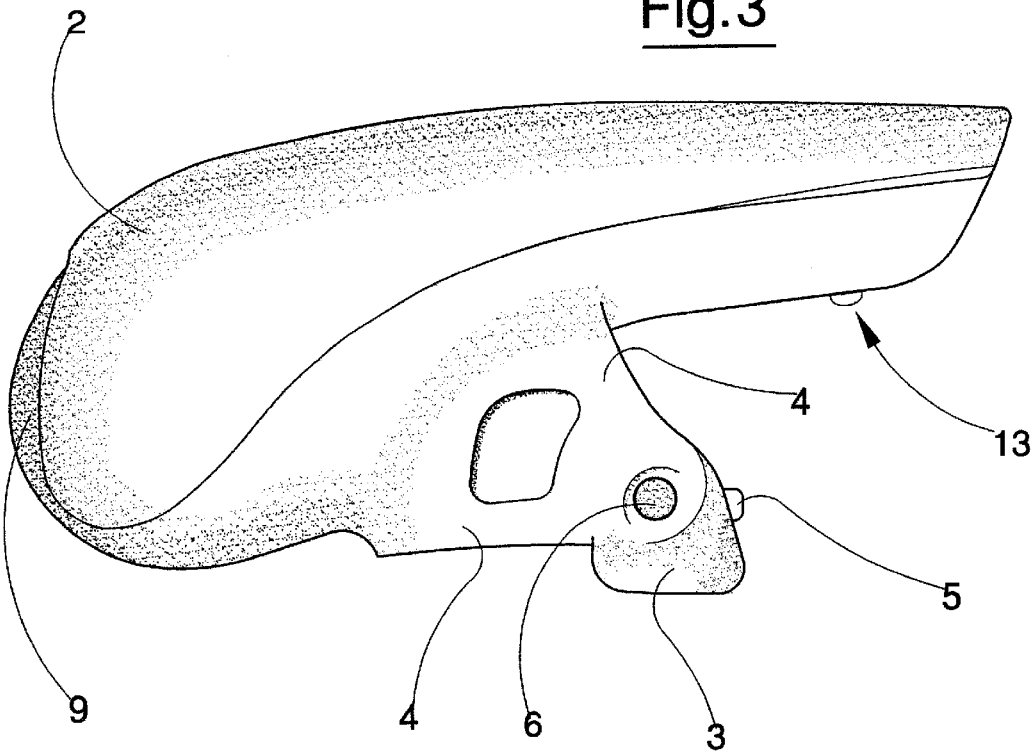
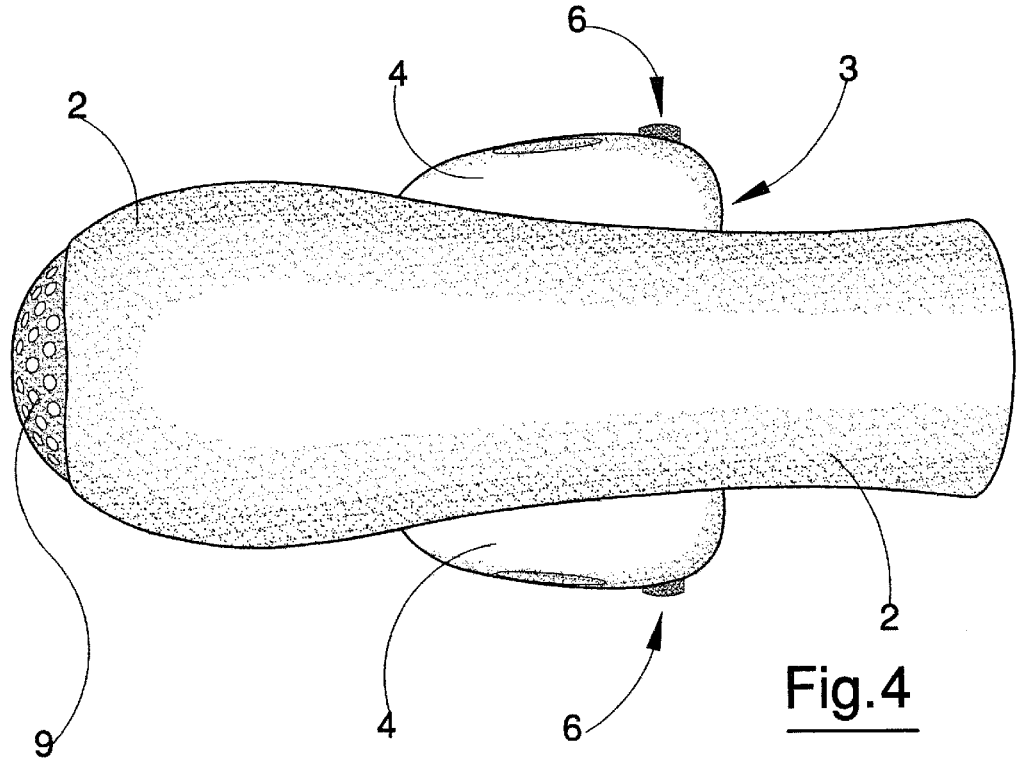
Fig.4

HAIR-DRYING APPARATUS

BACKGROUND OF THE INVENTION

The present invention relates to a hair-drying apparatus which, owing to a combination of structural and operational improvements, achieves new results in the form of more efficient handling and the possibility of operational regulation, together with an improved environmental impact such as, for example, a reduction in the noise level.

When using hair-drying apparatus currently available on the market, the operator is able to style hair only on a part of the head area directly in front of him or her: in other words, in order to dry hair around the neck, the operator, who is, for example, standing facing the person whose hair he/she is styling, has to move behind the person, i.e. perform a half-turn about him/her.

With the known apparatus, moreover, it is not in general possible to adequately regulate the volume of the air flow issued—it is instead necessary to fit one or more caps or accessories or end-nozzles onto the outlet mouth, so as to narrow, widen or direct the air flow issued.

The use of these end-nozzles is also inconvenient because it increases the number of objects the operator must keep to hand, as well as requiring a space for storing these accessories, such as a surface or shelf within arm's reach of the operator, taking up precious space.

Moreover, the operation of mounting and removing these end-nozzles distracts the operator's attention—albeit for a few seconds—from the working area and is therefore bothersome.

Finally, existing hair-drying apparatus generally make an excessive amount of noise due to the fan, in particular in the region of the air outlet mouth. This makes operation of the hair drier bothersome and detrimental for the person whose hair is being styled and the operator alike.

SUMMARY OF THE INVENTION

The object of the present invention is to provide a hair-drying apparatus which is versatile and easy to handle and enables and operator to style hair over the whole area of a person's head from one position.

A further object is to provide a system for regulating the air jet issued without fitting end-nozzles or external caps.

Last but not least, an important object is to achieve a reduction in noise level, especially in the region of the air outlet mouth.

These objects are all achieved by the folling: situating the handle of the hair-drying apparatus underneath the body of the apparatus, transversally and preferably perpendicular to the axis of symmetry of the apparatus; inserting a guillotine-type shutter inside the air outlet mouth; and offsetting the blower fan with respect to the longitudinal axis of the delivery duct.

BRIEF DESCRIPTION OF THE DRAWINGS

The invention will emerge more clearly from the description of a preferred embodiment illustrated hereinbelow with the aid of two drawings, in which:

FIGS. 2, 3 and 4 show an external view of the apparatus, respectively from the front, side and top, highlighting in particular the position of the handle and the location of the controls.

DESCRIPTION OF THE PREFERRED EMBODIMENTS

Figure 1:
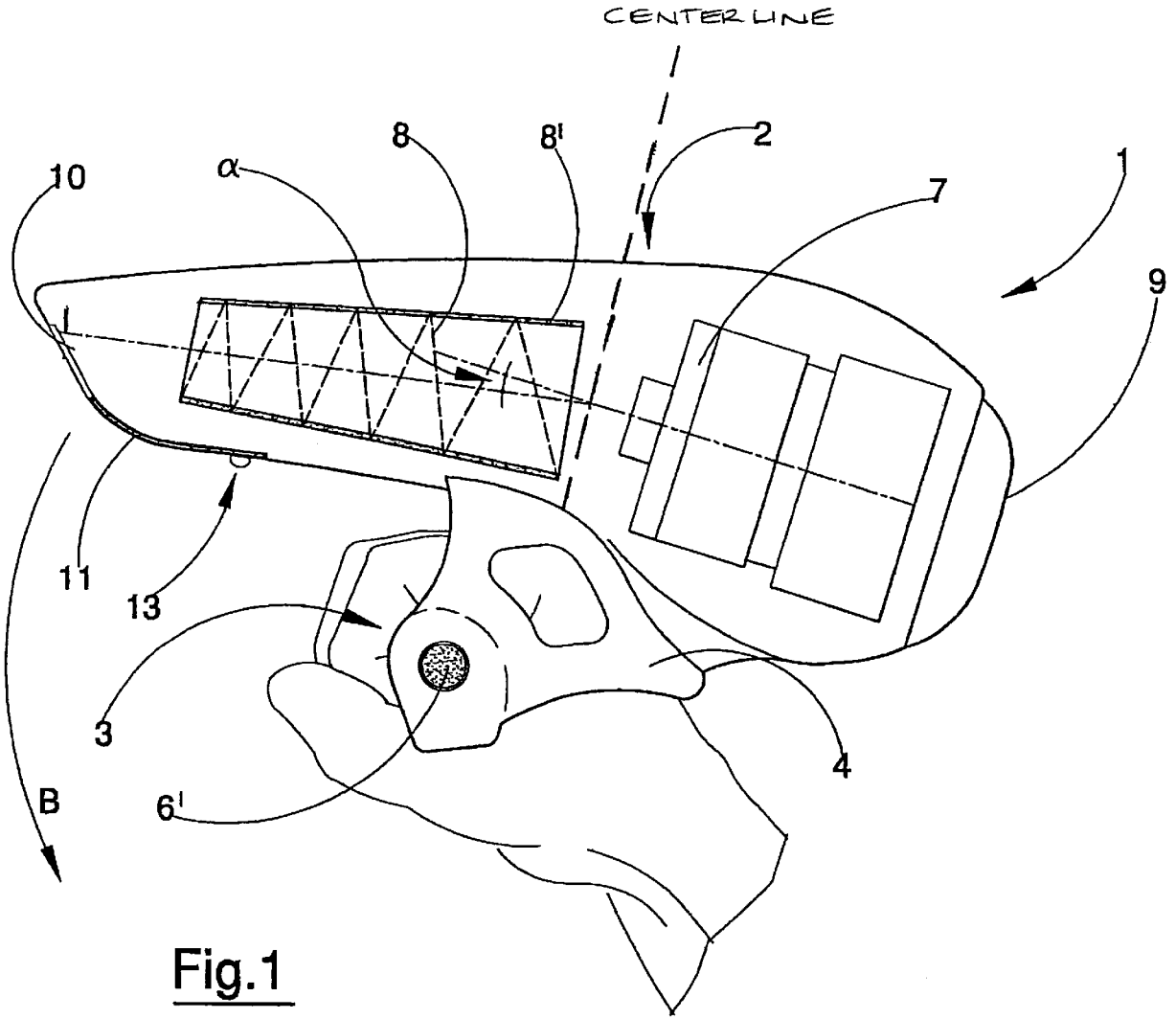
FIG. 1 shows a side view of the apparatus, suitably sectioned along the edge so as to show the most important internal components.
Figure 2:
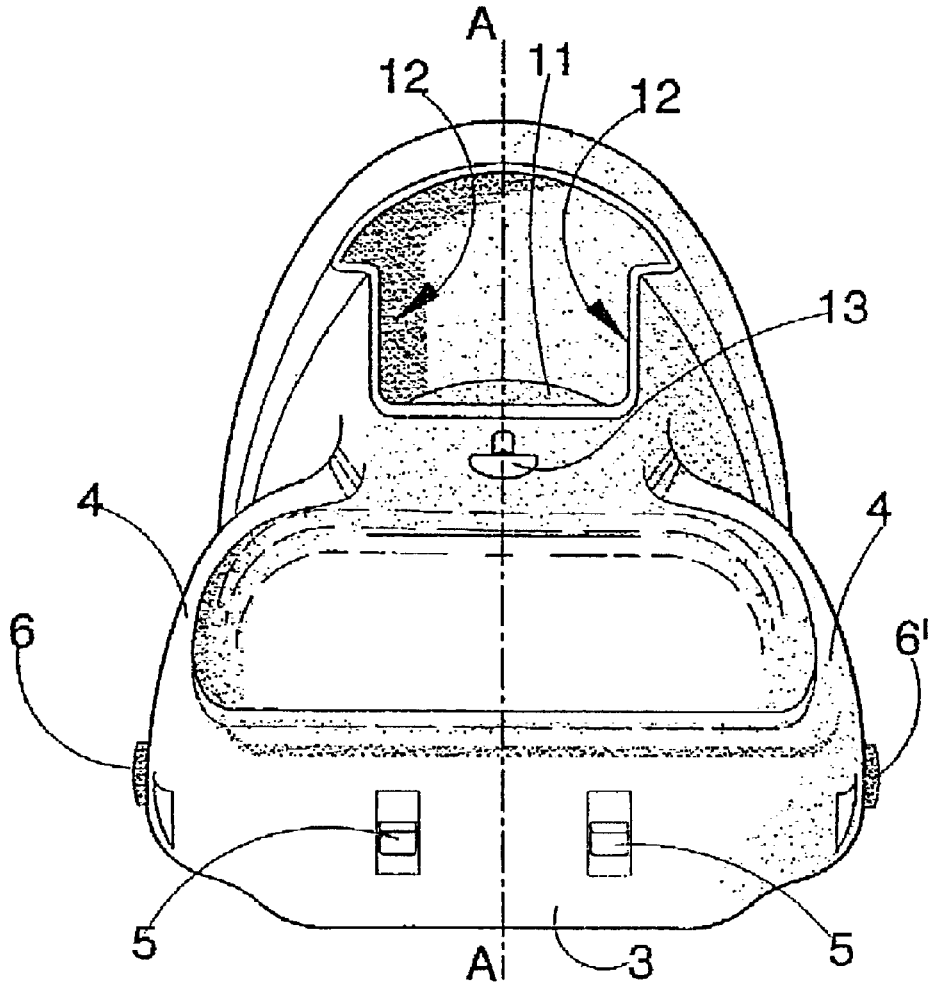

In these figures, 1 denotes in its entirety a hair-drying apparatus provided in accordance with the invention.

2 denotes the body of the apparatus, and 3 denotes a handle provided below the body 2 in a position which is transverse and preferably substantially perpendicular to the axis of symmetry A—A of the apparatus, and aligned substantially along a centerline of the main body of the apparatus there being provided sufficient space between the handle 3 and the body 2 of the apparatus to enable the fingers and the palm of a hand to be inserted.

4 denotes two curved elements joining together the body 2 and the handle 3, these curved elements 4 being rigidly connected to the body 2 and the handle 3.

5 and 6 denote electrical controls such as, for example, the start-up switch of an air blower unit of the apparatus consisting of an axial fan 7 or a speed switch for the fan, or a control switch for the air heating resistance 8.

The resistance 8 is duct-shaped, more precisely in the form of a truncated cylinder or truncated cone 8'.

The controls 6 and 6', preferably symmetrically positioned at the ends of the handle 3, are in a parallel circuit, so that they can perform the same functions and therefore be conveniently operated by the thumb of either the right hand or the left hand.

9 denotes a holed rear intake cap, 10 a front opening or outlet mouth, the area of which can be altered by sliding a guillotine-type shutter 11 which slides on two lateral guides 12; the operator moving the shutter 11 by operating the knob 13 on the shutter itself.

The operating principle is as follows:

The operator takes hold of the hair drier by inserting the fingers and palm of a hand (either left or right) and gripping the handle 3.

With the thumb, the operator can easily operate the switch 6, 6' located on the side of the handle for turning the apparatus on or off.

Using the fingers, he/she is able to regulate and operate the controls 5 located on the front part of the handle 3, regulating for example the speed of the fan 7, or the temperature of the output air by means of the resistance 8 controls. By slightly loosening his or her grip on the handle 3, the operator can rotate the hair drier downwards, as indicated by the arrow B, thus varying the direction of the air jet by even as much as 180° so as to reach, for example, the neck of the person whose hair is being styled, without having physically to change position with respect to said person.

The form of the air jet may be modified without fitting external accessories or caps, by simply operating the knob 13 which causes the guillotine-type shutter 11 to slide on the guides 12, thereby widening or narrowing the outlet opening 10.

Since this operation is performed on a "one-off" basis, the operator will use the other hand to do it, i.e. the hand not holding the hair-drying apparatus.

Finally, the overall curved shape of the body 2 of the apparatus allows the axes of the axial fan 7 and the duct 8' containing the electrical air-heating resistance 8 to be offset with respect to each other: this achieves the surprising result of reducing the noise level during operation of the apparatus, since the sound waves emitted by the fan are reflected by the internal top part of the body 2 and the duct 8', thereby lowering the noise level and making operation of the apparatus more pleasant.

It is envisaged that the angle α between the axis of the fan 7 and the axis of symmetry of the duct 8' is at least 5°.

The set objects are thus achieved, resulting in a new overall result of easy handling, easy use, versatility and comfort.

The invention is susceptible to numerous variations.

For example, the angle α between the axis of the motor and the axis of the resistance-carrying section may be much greater than 5°, or the functions assigned to the switches 5 and 6, or their relative positions, could be different.

What is claimed is:

1. A hair-drying apparatus comprising a handle located below a main body of the apparatus, wherein a longitudinal axis of the handle is arranged substantially perpendicular to an axis of symmetry of the apparatus.

2. The apparatus of claim 1, wherein the handle and the main body are reciprocally arranged in order to afford a space there-between which is sufficient for insertion of the fingers and the palm of a hand.

3. The apparatus of claim 2, wherein two symmetrical controls designed to perform a same electrical function are located on opposite ends of the handle.

4. A hair-drying apparatus comprising an axial fan and an internal air-heating unit, wherein the axis of rotation of the axial fan is inclined with respect to the axis of the heating duct, the inclination being of an entity of at least 5°.

5. A hair-drying apparatus comprising an air blower unit and an internal air-heating unit, wherein a shutter is provided at the outlet mouth; the shutter operating by sliding on two lateral guides; the shutter being connected to an external operating knob.

* * * * *